US010295935B2

(12) United States Patent
Guslitzer et al.

(10) Patent No.: US 10,295,935 B2
(45) Date of Patent: May 21, 2019

(54) ELECTROSTATIC PRINTING APPARATUS AND INTERMEDIATE TRANSFER MEMBERS

(71) Applicant: HP Indigo B.V., Amstelveen (NL)

(72) Inventors: Regina Guslitzer, Nes Ziona (IL); Dina Voloshin Firouz, Nes Ziona (IL); Sergey Inotaev, Nes Ziona (IL)

( * ) Notice: Subject to any disclaimer, the term of this patent is extended or adjusted under 35 U.S.C. 154(b) by 73 days.

(21) Appl. No.: 15/521,847

(22) PCT Filed: Oct. 31, 2014

(86) PCT No.: PCT/EP2014/073502
§ 371 (c)(1),
(2) Date: Apr. 25, 2017

(87) PCT Pub. No.: WO2016/066232
PCT Pub. Date: May 6, 2016

(65) Prior Publication Data

US 2017/0248874 A1 Aug. 31, 2017

(51) Int. Cl.
*G03G 15/01* (2006.01)
*G03G 15/16* (2006.01)

(52) U.S. Cl.
CPC ..... *G03G 15/162* (2013.01); *G03G 15/0173* (2013.01); *G03G 15/1685* (2013.01)

(58) Field of Classification Search
None
See application file for complete search history.

(56) References Cited

U.S. PATENT DOCUMENTS 4,446,279 A * 5/1984 Keogh ..... C08K 5/0091 264/171.19
4,609,574 A 9/1986 Keryk et al.
5,281,506 A 1/1994 Badesha et al.
5,888,649 A * 3/1999 Curatolo ..... C09D 4/00 428/352
6,014,155 A 1/2000 Mammino et al.
(Continued)

FOREIGN PATENT DOCUMENTS

EP 0320533 6/1989
EP 351797 1/1990
(Continued)

OTHER PUBLICATIONS

Gelest, Reactive Silicones: Forging new polymer links (Year: 2013).*
(Continued)

*Primary Examiner* — Roy Y Yi
(74) *Attorney, Agent, or Firm* — HP Inc. Patent Department

(57) ABSTRACT

Electrostatic printing apparatus and intermediate transfer members Herein is disclosed an intermediate transfer member for use in an electrostatic printing process, the intermediate transfer member having an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane. An electrostatic printing apparatus comprising the intermediate transfer member is also disclosed.

20 Claims, 3 Drawing Sheets

(56) References Cited

U.S. PATENT DOCUMENTS

| | | | |
|---|---|---|---|
| 6,020,098 | A | 2/2000 | Bretscher et al. |
| 6,342,324 | B1 | 1/2002 | Li et al. |
| 7,074,488 | B2 | 7/2006 | Pickering et al. |

FOREIGN PATENT DOCUMENTS

| | | |
|---|---|---|
| EP | 0982335 | 3/2000 |
| EP | 1011033 | 6/2000 |
| WO | WO-2013/060377 | 5/2013 |

OTHER PUBLICATIONS

International Search Report and Written Opinion for International Application No. PCT/EP2014/073502 dated Jul. 27, 2015, 12 pages.

* cited by examiner

ELECTROSTATIC PRINTING APPARATUS AND INTERMEDIATE TRANSFER MEMBERS

Electrostatic printing processes typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, in some examples, by being first transferred to an intermediate transfer member, which can be a soft swelling blanket, and then to the print substrate.

DETAILED DESCRIPTION

Figure 1:
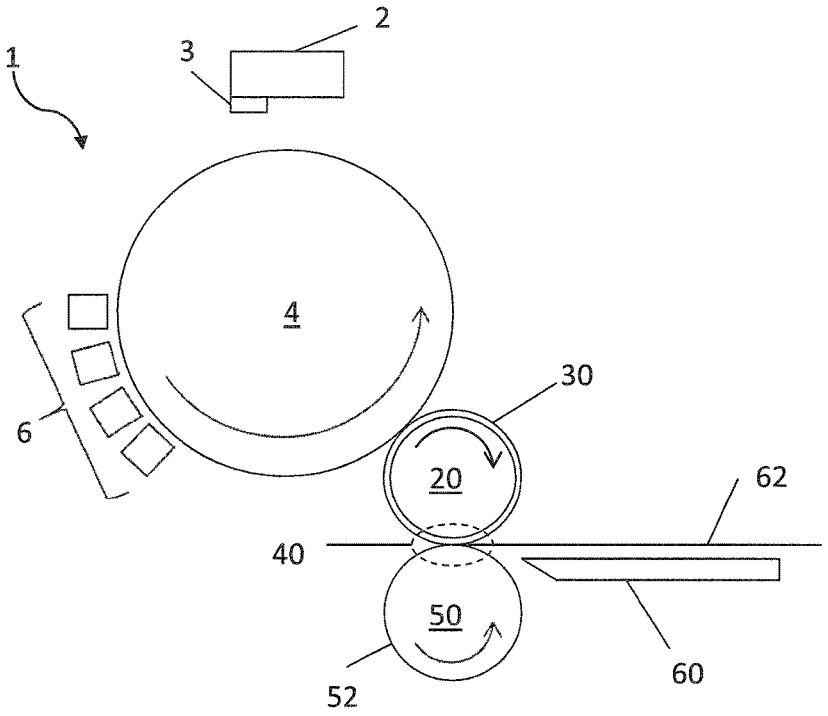
FIG. 1 is a schematic illustration an example of an electrostatic printing apparatus.

Before the electrostatic printing apparatus, intermediate transfer members and related aspects are disclosed and described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic ink or electrophotographic ink. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to an ink composition that is typically suitable for use in an electrostatic printing process, sometimes termed an electrophotographic printing process. The electrostatic ink composition may include chargeable particles of the resin and the pigment dispersed in a liquid carrier, which may be as described herein.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly, or indirectly via an intermediate transfer member, to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 1000 V/cm or more, or in some examples 1500 V/cm or more.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

In an aspect, there is provided an electrostatic printing apparatus. The electrostatic printing apparatus may comprise:

a photoconductive member having a surface on which can be created a latent electrostatic image; and an intermediate transfer member having an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane. The electrostatic printing apparatus may be adapted, in use, on contacting the surface of the photoconductive member with an electrostatic ink composition to form a developed toner image on the surface of the latent electrostatic image, then transfer the developed toner image to the outer release layer of intermediate transfer member, and then transfer the developed toner image from the outer release layer of the intermediate transfer member to a print substrate.

In an aspect, there is also provided an intermediate transfer member for use in an electrostatic printing process. The intermediate transfer member may have an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane.

R is an alkylene moiety, and, in some examples, may be of the formula $—(CH_2)_n—$, wherein n is an integer; in some examples n is from 2 to 10, in some examples from 2 to 8, in some examples from 2 to 5, in some examples n is selected from 2, 3 and 4. If, as suggested below, the crosslinking is from reacting a first component comprising a polysiloxane having at least two alkene groups per molecule with a second component comprising a polysiloxane having a silicon hydride moiety, the value of n will reflect the number of carbons in each of the two alkene groups of the polysiloxane having at least two alkene groups per molecule. For example, if the first component comprising a polysiloxane having at least two alkene groups per molecule is a divinylpolysiloxane, the value of n will be 2.

In some examples, the polysiloxane has been cross-linked using an addition cure process involving the addition cure of a first component comprising a polysiloxane having at least two alkene groups per molecule a second component comprising a polysiloxane having a silicon hydride moiety a third component comprising the monoalkenylsiloxane.

Monoalkenylsiloxane

The monoalkenylsiloxane may have been reacted with and incorporated into the polysiloxane of the intermediate transfer member. The monoalkenyl group of the monoalkenylsiloxane has preferably been reacted in an addition cure process with a silicon hydride (Si—H) moiety that forms part of the polysiloxane of the intermediate transfer member. This will have the effect of forming an alkylene linkage (i.e. a $—(CH_2)_m—$ linkage, where m is an integer), between the silicon from the silicon hydride moiety and the silicon that was attached (before the addition cure reaction) to the monoalkenyl group. In other words, the monoalkylene group is converted to an alkylene linkage by virtue of the addition cure reaction.

In some examples, the monoalkenylsiloxane or third component comprises a monovinyl siloxane, wherein the vinyl group of the monovinyl siloxane is covalently bonded to an end siloxyl unit of the siloxane chain or an intermediate siloxyl unit of the siloxane chain, and, in some examples, the rest of the siloxyl units of the siloxane chain have unsubstituted alkyl or aryl groups attached. An end siloxyl unit may be termed a siloxyl unit in which the silicon is attached to a single oxygen (which is in turn attached to another silicon atom); this is sometimes termed a type M siloxyl unit. An intermediate siloxyl unit is a mid-chain siloxyl unit, i.e. in which the silicon atom is linked to two, three or four oxygen atoms (which are each in turn linked to other silicon atoms). An intermediate siloxyl unit in which the silicon atom is linked to two oxygen atoms (which are each in turn linked to other silicon atoms) may be termed a type D siloxyl unit. An intermediate siloxyl unit in which the silicon atom is linked to three oxygen atoms (which are each in turn linked to other silicon atoms) may be termed a type T siloxyl unit. An intermediate siloxyl unit in which the silicon atom is linked to four oxygen atoms (which are each in turn linked to other silicon atoms) may be termed a type Q siloxyl unit.

The unsubstituted alkyl groups mentioned herein may be a C1 to C6 unsubstituted alkyl group, which may be straight-chain or branched. In some examples, the unsubstituted alkyl groups may be selected from methyl, ethyl, propyl, butyl and pentyl. In some examples, all unsubstituted alkyl groups are methyl.

The unsubstituted aryl groups mentioned herein may be selected from phenyl and naphthyl.

In some examples, the monoalkenyl group of the monoalkenylsiloxane or third component is a group of the formula $(CH_2{=}CH)_x—(CH_2)_y—$, wherein x is 1 or more, and y is from 0 to 10; in some examples x is 1, and y is from 0 to 3, in some examples 0, 1 or 2.

In some examples, the monoalkenylsiloxane or third component comprises a monovinyl siloxane, and, in some examples, the siloxane chain of the monovinyl siloxane is a straight chain. In some examples, the monoalkenylsiloxane or third component comprises a monovinyl siloxane, and, in some examples, the siloxane chain of the monovinyl siloxane is a branched chain. In some examples, the vinyl group of the monovinyl siloxane is covalently bonded to an end siloxyl unit of the siloxane chain, and the rest of the siloxyl units of the siloxane chain have unsubstituted alkyl or aryl groups attached.

In some examples, the monoalkenylsiloxane or third component comprises a monovinyl siloxane, wherein the siloxane chain of the monovinyl siloxane is a straight chain, the vinyl group of the monovinyl siloxane is covalently bonded to an end siloxyl unit of the siloxane chain, and, in some examples, the rest of the siloxyl units of the siloxane chain have unsubstituted alkyl or aryl groups attached.

In some examples, the monoalkenylsiloxane or third component is selected from α,ω-(dimethylvinylsiloxy)polydimethylsiloxane or a polysiloxane of poly(dimethylsiloxy)(methyl-vinyl-siloxy)α,ω(trimethylsiloxy) type. 'α,ω' indicate end siloxyl units.

In some examples, the monoalkenylsiloxane or third component, which may be or comprise a monovinyl siloxane, has a dynamic viscosity of at least 1000 mPa·s, in some examples at least 5000 mPa·s, in some examples at least 10,000 mPa·s, in some examples at least 20,000 mPa·s, in some examples a dynamic viscosity of at least 30,000 mPa·s.

In some examples, the monoalkenylsiloxane or third component, which may be or comprise a monovinyl siloxane, has a dynamic viscosity that is more than the dynamic viscosity of each of the second and/or third components. In some examples, the monoalkenylsiloxane or third component, which may be or comprise a monovinyl siloxane, has a dynamic viscosity that is at least twice the dynamic viscosity of each of the second and/or third components, in some examples at least three times the dynamic viscosity of each of the second and/or third components, in some examples at least four times the dynamic viscosity of each of the second and/or third components in some examples at least five times the dynamic viscosity of each of the second and/or third components.

In some examples, the monoalkenylsiloxane or third component, which may be or comprise a monovinyl siloxane, has a dynamic viscosity of from 10.00 mPa·s to 80,000 mPa·s, in some examples a dynamic viscosity of from 10,000 mPa·s to 80,000 mPa·s, in some examples a dynamic viscosity of from 10,000 mPa·s to 60,000 mPa·s, in some examples a dynamic viscosity of from 20,000 mPa·s to 50,000 mPa·s, in some examples a dynamic viscosity of from 25,000 mPa·s to 45,000 mPa·s, in some examples a dynamic viscosity of from 30,000 mPa·s to 40,000 mPa·s, in some examples a dynamic viscosity of from 33,000 mPa·s to 37,000 mPa·s, in some examples a dynamic viscosity of about 35,000 mPa·s.

In some examples, the monoalkenylsiloxane, the third component, which may be or comprise a monovinyl siloxane, has is present in an amount of from 1 wt % to 20 wt % of the combined weight of the first, second and third components, in some examples an amount of from 5 wt % to 12 wt % of the combined weight of the first, second and third components.

First Component

In some examples, the first component comprises a dimethylsiloxane homopolymer, in which the alkene groups are vinyl, and are each covalently bonded to end siloxyl units. In some examples, the first component comprises a dimethylsiloxane homopolymer, in which the alkene groups are vinyl, and are each covalently bonded to intermediate siloxyl units. In some examples, the first component comprises a dimethylsiloxane homopolymer of the α,ω(dimethyl-vinylsiloxy)poly(dimethylsiloxyl) type. In some examples, the first component, which may be or comprise a dimethylsiloxane homopolymer, has a dynamic viscosity of at least 100 mPa·s. In some examples, the first component, which may be or comprise a dimethylsiloxane homopolymer, has a dynamic viscosity of from 100 to 1000 mPa·s, in some examples 200 to 900 mPa·s, in some examples 300 to 800 mPa·s, in some examples 400 to 700 mPa·s, in some examples 400 to 600 mPa·s, in some examples about 500 mPa·s. In some examples, the dimethylsiloxane homopolymer has a dynamic viscosity of from 100 to 1000 mPa·s, in some examples 200 to 900 mPa·s, in some examples 300 to 800 mPa·s, in some examples 400 to 700 mPa·s, in some examples 400 to 600 mPa·s, in some examples about 500 mPa·s.

In some example, the first component comprises a co-polymer of vinylmethylsiloxane and dimethylsiloxane, and in some examples, a vinyl group is covalently bonded to each of the end siloxyl units of the co-polymer. In some examples the co-polymer of vinylmethylsiloxane and dimethylsiloxane is of the poly(dimethylsiloxyl)(methylvinylsiloxy)α,ω(dimethyl-vinylsiloxy) type.

In some examples, the first component comprises a dimethylsiloxane homopolymer, in which the alkene groups are vinyl, and are each covalently bonded to end siloxyl units, which may be as described above, and a co-polymer of vinylmethylsiloxane and dimethylsiloxane, and, in some examples a vinyl group is covalently bonded to each of the end siloxyl units of the co-polymer.

In some examples, the co-polymer of vinylmethylsiloxane and dimethylsiloxane has a dynamic viscosity of from 1000 to 5000 mPa·s. In some examples, the co-polymer of vinylmethylsiloxane and dimethylsiloxane has a dynamic viscosity of from 2000 to 4000 mPa·s, in some examples a dynamic viscosity of from 2500 to 3500 mPa·s, in some examples a dynamic viscosity of about 3000 mPa·s.

Second Component

The second component comprises a polysiloxane having a silicon hydride (Si—H) moiety. The silicon hydride moiety may be at an end siloxyl unit or an intermediate siloxyl unit in the polysiloxane of the second component; and in some examples, all other substituents attached to the silicon atoms of the polysiloxane having a silicon hydride (Si—H) moiety are unsubstituted alkyl or unsubstituted aryl groups. In some examples, the second component is selected from a polysiloxane of the poly(dimethylsiloxy)-(siloxymethylhydro)-α,ω-(dimethylhydrosiloxy) type and α,ω-(dimethylhydrosiloxy) poly-dimethylsiloxane. In some examples, the polysiloxane having a silicon hydride (Si—H) moiety has a dynamic viscosity of at least 100 mPa·s, in some examples at least 500 mPa·s. In some examples, the polysiloxane having a silicon hydride (Si—H) moiety has a dynamic viscosity of from 100 mPa·s to 2000 mPa·s, in some examples a dynamic viscosity of from 300 mPa·s to 1500 mPa·s, in some examples a dynamic viscosity of from 500 mPa·s to 1300 mPa·s, in some examples a dynamic viscosity of from 700 mPa·s to 1100 mPa·s, in some examples a dynamic viscosity of from 800 mPa·s to 1000 mPa·s, in some examples a dynamic viscosity of around 900 mPa·s.

In some examples, the polysiloxane has been cross-linked using an addition cure process involving the addition cure of

- a first component comprising a polysiloxane having at least two alkene groups per molecule
- a second component comprising a polysiloxane having a silicon hydride moiety
- a third component comprising the monoalkenylsiloxane, wherein the first component is selected from a dimethylsiloxane homopolymer of the α,ω(dimethyl-vinylsiloxy)poly(dimethylsiloxyl) type and a co-polymer of vinylmethylsiloxane and dimethylsiloxane of the poly(dimethylsiloxyl)((methylvinylsiloxy)α,ω(dimethyl-vinylsiloxy) type;
- the second component is selected from a polysiloxane of the poly(dimethylsiloxy)-(siloxymethy)-α,ω-(dimethylhydrosiloxy) type and α,ω-(dimethylhydrosiloxy) poly-dimethylsiloxane; and
- the third component is selected from α,ω(dimethylvinylsiloxy)polydimethylsiloxane or a polysiloxane of poly-dimethylsiloxy)methyl-vinyl-siloxy)α,ω(trimethylsiloxy) type.

In some examples, the polysiloxane has been cross-linked using an addition cure process involving the addition cure of

- a first component comprising a polysiloxane having at least two alkene groups per molecule,
- a second component comprising a polysiloxane having a silicon hydride moiety,
- a third component comprising the monoalkenylsiloxane, wherein the third component comprises a monovinyl siloxane, wherein the siloxane chain of the monovinyl siloxane is a straight chain, the vinyl group of the monovinyl siloxane is covalently bonded to an end siloxyl unit of the siloxane chain, and the rest of the siloxyl units of the siloxane chain have unsubstituted alkyl or aryl groups attached, the monovinyl siloxane having a dynamic viscosity of at least 20,000 mPa·s. The first and second components may be as described herein.

In some examples, the polysiloxane has been cross-linked using an addition cure process involving the addition cure of

- a first component comprising a polysiloxane having at least two alkene groups per molecule a second component comprising a polysiloxane having a silicon hydride moiety a third component comprising the monoalkenylsiloxane, wherein the first component is selected from a dimethylsiloxane homopolymer of the α,ω(dimethyl-vinylsiloxy)poly(dimethylsiloxyl) type and a co-polymer of vinylmethylsiloxane and dimethylsiloxane of the poly (dimethylsiloxyl)((methylvinylsiloxy)α,ω(dimethyl-vinylsiloxy) type;

the second component is selected from a polysiloxane of the poly(dimethylsiloxy)-(siloxymethy)-α,ω-(dimethylhydrosiloxy) type and α,ω-(dimethylhydrosiloxy) poly-dimethylsiloxane; and the third component is selected from α,ω(dimethylvinylsiloxy)polydimethylsiloxane or a polysiloxane of polydimethylsiloxy)methyl-vinyl-siloxy)α,ω(trimethylsiloxy) type, the third component has a dynamic viscosity of at least 20,000 mPa·s, which is more than the dynamic viscosity of the first and second components, which may be as described above.

In some examples, viscosities described herein may be determined according to ASTM D4283-98(2010) Standard Test Method for Viscosity of Silicone Fluids. In some examples, viscosities described herein may be measured on a viscometer, such as a Brookfield DV-II+Programmable viscometer, using appropriate spindles, including, but not limited to, a spindle selected from spindle LV-4 (SP 64) 200-1,000 [mPa·s] for Newtonian fluids (pure silicones) and spindle LV-3 (SP 63).

The addition cure may involve the presence of a catalyst, for example a platinum- or rhodium-containing platinum. The catalyst may be present in the release layer, e.g. with first, second and third components, during the addition cure reaction. The catalyst may be termed an addition cure catalyst, and the addition cure catalyst may be selected from platinum(0)-1,3-divinyl-1,1,3,3-tetramethyldisiloxane, platinum carbonyl cyclovinylmethylsiloxane complex, platinum octanolaldehyde/octanol complex and tris(dibutylsulfide)rhodium trichloride.

The intermediate transfer member may be termed an ITM herein for brevity. The ITM may comprise a supportive portion on which the outer release layer is disposed. The ITM may have a base, for example a metal base. The base may have a cylindrical shape. The base may form part of the supportive portion of the ITM.

The ITM may have a cylindrical shape, as such the ITM may be suitable for use as a roller, for example a roller in a printing apparatus.

The supportive portion of the ITM may comprise a layered structure disposed on the base of the ITM. The layered structure may comprise a compliant substrate layer, for example a rubber layer, on which the outer release layer may be disposed.

The compliant substrate layer may comprise a rubber layer comprise an acrylic rubber (ACM), a nitrile rubber (NBR), a hydrogenated nitrile rubber (HNBR), a polyurethane elastomer (PU), an EPDM rubber (an ethylene propylene diene terpolymer), a fluorosilicone rubber (FMQ or FLS), a fluorocarbon rubber (FKM or FPM) or a perfluorocarbon rubber (FFKM).

The ITM may comprise a primer layer to facilitate bonding or joining of the release layer to the compliant layer. The primer layer may form part of the supportive portion of the ITM, in some examples the primer layer is disposed on the compliant substrate layer.

In some examples, the primer layer may comprise an organosilane, for example, an organosilane derived from an epoxysilane such as 3-glycidoxypropyl trimethylsilane, a vinyl silane such as vinyltriethoxysilane, a vinyltriethoxysilane, an allyl silane, or an unsaturated silane, and a catalyst such as a catalyst comprising titanium or platinum.

The primer layer may be formed from a curable primer layer. The curable primer layer may be applied to the compliant substrate layer of the supportive portion of the ITM before the outer release layer is formed on the supportive portion. The curable primer layer may comprise an organosilane and a catalyst, for example a catalyst comprising titanium.

In some examples the organosilane contained in the curable primer layer is selected from an epoxysilane, a vinyl silane, an allyl silane and an unsaturated silane.

The curable primer layer may comprise a first primer and a first catalyst, and a second primer and, in some examples, a second catalyst. The first primer and/or the second primer may comprise an organosilane. The organosilane may be selected from an epoxysilane, a vinyl silane, an allyl silane and an unsaturated silane.

In some examples, the first catalyst is a catalyst for catalysing a condensation cure reaction, for example a catalyst comprising titanium. The first primer may be cured by a condensation reaction by the first catalyst. The second primer may be cured by a condensation reaction by the first catalyst.

In some examples, the second catalyst is a catalyst for catalysing an addition cure reaction. In such cases, the second catalyst may catalyse an addition cure reaction of the pre-cure release composition to form the release layer.

The curable primer layer may be applied to the compliant layer as a composition containing the first and second primer and first and second catalyst.

In some examples the curable primer layer may be applied to the compliant layer as two separate compositions, one containing the first primer and first catalyst, the other containing the second primer and second catalyst.

In some examples, the ITM may comprise an adhesive layer for joining the compliant substrate layer to the base. The adhesive layer may be a fabric layer, for example a woven or non-woven cotton, synthetic, combined natural and synthetic, or treated, for example, treated to have improved heat resistance, material.

The compliant substrate layer may be formed of a plurality of compliant layers. For example, the compliant substrate layer may comprise a compressible layer, a compliance layer and/or a conductive layer.

In some examples the compressible layer is disposed on the base of the ITM. The compressible layer may be joined to the base of the ITM by the adhesive layer. A conductive layer may be disposed on the compressible layer. The compliance layer may then be disposed on the conductive layer if present, or disposed on the compressible layer if no conductive layer is present.

The compressible layer may be a rubber layer which, for example, may comprise an acrylic rubber (ACM), a nitrile rubber (NBR), a hydrogenated nitrile rubber (HNBR), a polyurethane elastomer (PU), an EPDM rubber (an ethylene propylene diene terpolymer), or a fluorosilicone rubber (FLS).

The compliance layer may comprise a soft elastomeric material having a Shore A hardness of less than about 65, or a Shore A hardness of less than about 55 and greater than about 35, or a Shore A hardness value of between about 42 and about 45. In some examples, the compliance layer 27 comprises a polyurethane or acrylic. Shore A hardness is determined by ASTM standard D2240.

In some examples, the compliance layer comprises an acrylic rubber (ACM), a nitrile rubber (NBR), a hydrogenated nitrile rubber (HNBR), a polyurethane elastomer (PU), an EPDM rubber (an ethylene propylene diene terpolymer), a fluorosilicone rubber (FMQ), a fluorocarbon rubber (FKM or FPM) or a perfluorocarbon rubber (FFKM)

In an example the compressible layer and the compliance layer are formed from the same material.

The conductive layer may comprise a rubber, for example an acrylic rubber (ACM), a nitrile rubber (NBR), a hydrogenated nitrile rubber (HNBR), or an EPDM rubber (an ethylene propylene diene terpolymer), and one or more conductive materials.

In some examples, the compressible layer and/or the compliance layer may be made to be partially conducting with the addition of conducting particles, for example conductive carbon black or metal fibres. In some examples where the compressible layer and/or the compliance layer are partially conducting there may be no requirement for an additional conductive layer.

Electrostatic Liquid Electro Photographic (LEP) Printing Apparatus

FIG. 1 shows a schematic illustration of an example of an LEP 1. An image, including any combination of graphics, text and images, is communicated to the LEP 1.

The LEP includes a photo charging unit 2 and a photo-imaging cylinder 4. The image is initially formed on a photo-conductive member in the form of a photo-imaging cylinder 4 before being transferred to an outer release layer 30 of the ITM 20 which is in the form of a roller (first transfer), and then from the outer release layer 30 of the ITM 20 to a print substrate 62 (second transfer).

According to an illustrative example, the initial image is formed on a rotating photo-imaging cylinder 4 by the photo charging unit 2. Firstly, the photo charging unit 2 deposits a uniform static charge on the photo-imaging cylinder 4 and then a laser imaging portion 3 of the photo charging unit 2 dissipates the static charges in selected portions of the image area on the photo-imaging cylinder 4 to leave a latent electrostatic image. The latent electrostatic image is an electrostatic charge pattern representing the image to be printed. Ink is then transferred to the photo-imaging cylinder 4 by Binary Ink Developer (BID) units 6. The BID units 6 present a uniform film of ink to the photo-imaging cylinder 4. The ink contains electrically charged pigment particles which, by virtue of an appropriate potential on the electrostatic image areas, are attracted to the latent electrostatic image on the photo-imaging cylinder 4. The ink does not adhere uncharged, non-image areas and forms a developed toner image on the surface of the latent electrostatic image. The photo-imaging cylinder 4 then has a single colour ink image on its surface.

The developed toner image is then transferred from the photo-imaging cylinder 4 to the outer release layer 30 of the ITM 20 by electrical forces. The image is then dried and fused on the outer release layer 30 of the ITM 20 before being transferred from the outer release layer 30 of the ITM 20 to a print substrate wrapped around an impression cylinder 50. The process may then be repeated for each of the coloured ink layers to be included in the final image.

The image is transferred from the photo-imaging cylinder 4 to the ITM 20 by virtue of an appropriate potential applied between the photo-imaging cylinder 4 and the ITM 20, such that the charged ink is attracted to the ITM 20.

Between the first and second transfers the solid content of the developed toner image is increased and the ink is fused on to the ITM 20. For example, the solid content of the developed toner image deposited on the outer release layer 30 after the first transfer is typically around 20%, by the second transfer the solid content of the developed toner image is typically be around 80-90%. This drying and fusing is typically achieved by using elevated temperatures and air flow assisted drying. In some examples, the ITM 20 is heatable.

The print substrate 62 is fed into the printing apparatus by the print substrate feed tray 60 and is wrapped around the impression cylinder 50. As the print substrate 62 contacts the ITM 20, the single colour image is transferred to the print substrate 62.

To form a single colour image (such as a black and white image), one pass of the print substrate 62 through the impression cylinder 50 and the ITM 20 completes the image. For a multiple colour image, the print substrate 62 is retained on the impression cylinder 50 and makes multiple contacts with the ITM 20 as it passes through the nip 40. At each contact an additional colour plane may be placed on the print substrate 62.

Intermediate Transfer Member

Figure 2:
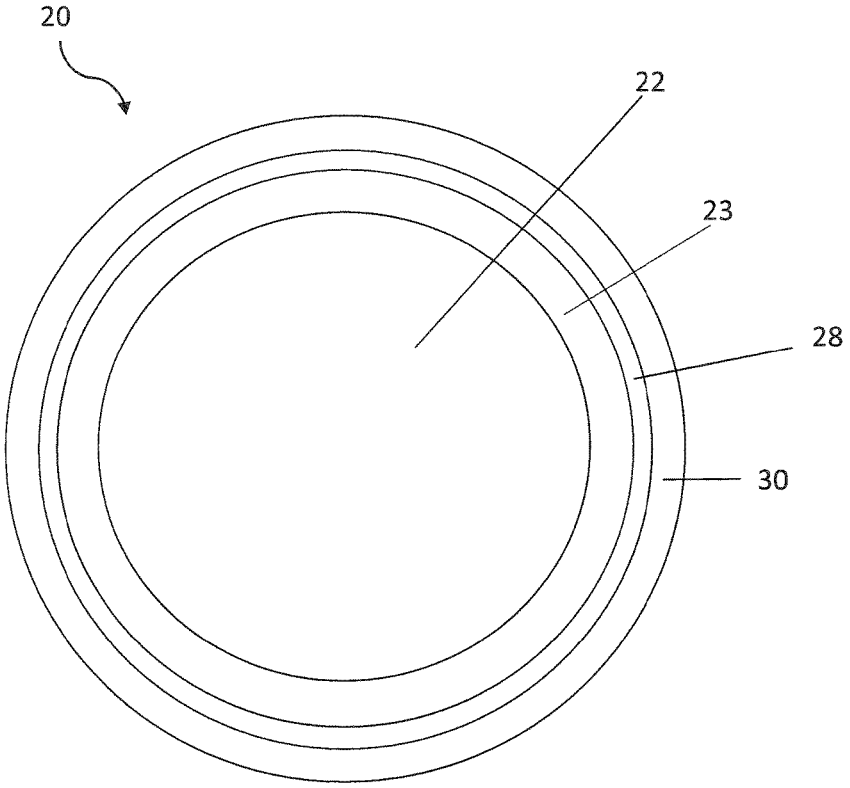
FIG. 2 is a cross-sectional diagram of an example of an intermediate transfer member (ITM).

FIG. 2 is a cross-sectional diagram of an example of an ITM. The ITM includes a supportive portion comprising a base 22 and a substrate layer 23 disposed on the base 22. The base 22 may be a metal cylinder. The ITM 20 also comprises a primer layer 28 disposed on the substrate layer 23, and an outer release layer 30 disposed on the primer layer 28.

The substrate layer 23 comprises a rubber layer which may comprise an acrylic rubber (ACM), a nitrile rubber (NBR), a hydrogenated nitrile rubber (HNBR), a polyurethane elastomer (PU), an EPDM rubber (an ethylene propylene diene terpolymer), a fluorosilicone rubber (FMQ or FLS), a fluorocarbon rubber (FKM or FPM) or a perfluorocarbon rubber (FFKM). For example, the rubber layer may comprise an at least partly cured acrylic rubber, for example an acrylic rubber comprising a blend of acrylic resin Hi-Temp 4051 EP (Zeon Europe GmbH, Niederkasseler Lohweg 177, 40547 Disseldorf, Germany) filled with carbon black pearls 130 (Cabot, Two Seaport Lane, Suite 1300, Boston, Mass. 02210, USA) and a curing system which may comprise, for example, NPC-50 accelerator (ammonium derivative from Zeon).

Figure 3:
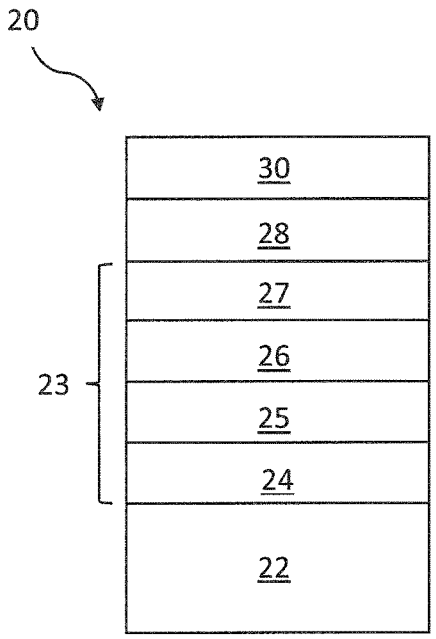
FIG. 3 is a cross-sectional diagram of an example of an ITM.

FIG. 3 shows a cross-sectional view of an example of an ITM having a substrate layer 23 comprising an adhesive layer 24 disposed between the base 22 and a compressible layer 25 for joining the compressible layer 25 of the substrate layer 23 to the base 22, a conductive layer 26 may be disposed on the compressible layer 25, and a compliance layer 27 disposed on the conductive layer 26. The adhesive layer may be a fabric layer, for example a woven or non-woven cotton, synthetic, combined natural and synthetic, or treated, for example, treated to have improved heat resistance, material. In an example the adhesive layer 23 is a fabric layer formed of NOMEX material having a thickness, for example, of about 200 μm.

The compressible layer 25 may be a rubber layer which, for example, may comprise an acrylic rubber (ACM), a nitrile rubber (NBR), a hydrogenated nitrile rubber (HNBR), a polyurethane elastomer (PU), an EPDM rubber (an ethylene propylene diene terpolymer), or a fluorosilicone rubber (FLS).

The compliance layer 27 may comprise a soft elastomeric material having a Shore A hardness of less than about 65, or a Shore A hardness of less than about 55 and greater than about 35, or a Shore A hardness value of between about 42 and about 45. In some examples, the compliance layer 27 comprises a polyurethane or acrylic. Shore A hardness is determined by ASTM standard D2240. In some examples, the compliance layer comprises an acrylic rubber (ACM), a nitrile rubber (NBR), a hydrogenated nitrile rubber (HNBR), a polyurethane elastomer (PU), an EPDM rubber (an ethylene propylene diene terpolymer), a fluorosilicone rubber (FMQ), a fluorocarbon rubber (FKM or FPM) or a perfluorocarbon rubber (FFKM)

In an example the compressible layer 25 and the compliance layer 27 are formed from the same material.

The conductive layer 26 comprises a rubber, for example an acrylic rubber (ACM), a nitrile rubber (NBR), a hydrogenated nitrile rubber (HNBR), or an EPDM rubber (an ethylene propylene diene terpolymer), and one or more conductive materials. In some examples, the conductive layer 26 may be omitted, such as in some examples in which the compressible layer 25, the compliance layer 27, or the release layer 30 are partially conducting. For example, the compressible layer 25 and/or the compliance layer 27 may be made to be partially conducting with the addition of conductive carbon black or metal fibres.

The primer layer 28 may be provided to facilitate bonding or joining of the release layer to the substrate layer 23. The primer layer 28 may comprise an organosilane, for example, an organosilane derived from an epoxysilane such as 3-glycidoxypropyl trimethylsilane, a vinyl silane such as vinyltriethoxysilane, a vinyltriethoxysilane, an allyl silane, or an unsaturated silane, and a catalyst such as a catalyst comprising titanium or platinum.

In an example, a curable primer layer is applied to a compliance layer 27 of a substrate layer 23, for example to the outer surface of a compliance layer 27 made from an acrylic rubber. The curable primer may be applied using a rod coating process. The curable primer may comprise a first primer comprising an organosilane and a first catalyst comprising titanium, for example an organic titanate or a titanium chelate. In an example the organosilane is an epoxysilane, for example 3-glycidoxypropyl trimethoxysilane (available from ABCR GmbH & Co. KG, Im Schlehert 10 D-76187, Karlsruhe, Germany, product code SIG5840) and vinyltriethoxysilane (VTEO, available from Evonik, Kirschenallee, Darmstadt, 64293, Germany), vinyltriethoxysilane, an allyl silane or an unsaturated silane. The first primer is curable by, for example, a condensation reaction. For example, the first catalyst for a silane condensation reaction may be an organic titanate such as Tyzor® AA75 (available from Dorf-Ketal Chemicals India Private Limited Dorf Ketal Tower, D'Monte Street, Orlem, Malad (W), Mumbai-400064, Maharashtra INDIA.). The primer may also comprise a second primer comprising an organosilane, e.g. a vinyl siloxane, such as a vinyl silane, for example vinyl triethoxy silane, vinyltriethoxysilane, an allyl silane or an unsaturated silane, and, in some examples, a second catalyst. The second primer may also be curable by a condensation reaction. The second catalyst, if present, may be different from the first catalyst and in some examples comprises platinum or rhodium. For example, the second catalyst may be a Karstedt catalyst with, for example, 9% platinum in solution (available from Johnson Matthey, 5th Floor, 25 Farringdon Street, London EC4A 4AB, United Kingdom) or a SIP6831.2 catalyst (available from Gelest, 11 East Steel Road, Morrisville, Pa. 19067, USA). This second primer may be cured by an addition reaction. The second catalyst in the second primer may be in contact with a pre-cure release composition applied onto the primer layer 28. In addition to catalysing the addition cure reaction of the second primer, the second catalyst may also catalyse the addition cure reaction of the pre-cure release composition to form the release layer 30.

The curable primer layer applied to the substrate layer 23 may comprise a first primer and/or a second primer. The curable primer layer may be applied to the substrate layer 23 as two separate layers, one layer containing the first primer and the other layer containing the second primer.

The rubbers of the compressible layer 25, the conductive layer 26 and/or the compliance layer 27 of the substrate layer 23 may be uncured when the curable primer layer is applied thereon.

The outer release layer 30 of the ITM 20 is or comprises a polysiloxane that has been cross-linked using an addition cure process such that it contains Si—R—Si bonds, wherein R is an alkylene moiety, and a monoalkenylsiloxane has been reacted with and incorporated into the polysiloxane.

The outer release layer 30 may be formed on the ITM by applying a pre-cure release layer composition to a supportive portion of the ITM. For example, the outer release layer may be applied to the substrate layer 23 or on top of a curable primer layer which has already been applied to the substrate layer 23. The curable primer layer and the release layer may have been cured and crosslinked, respectively, at the same time.

The pre-cure release layer composition may comprise at least one silicone oil having alkene groups linked to the silicone chain of the silicone oil; a cross-linker comprising a silicon hydride component, and a monoalkenylsiloxane. In some examples, the pre-cure release composition may contain a catalyst, for example a platinum containing catalyst or a rhodium containing catalyst.

In some examples, the at least one silicone oil may comprise a polysiloxane having at least two alkene groups per molecule. For example, the silicone oil may comprise a dimethylsiloxane homopolymer, in which the alkene groups are vinyl, and are each covalently bonded to end siloxyl units. In some examples, the silicone oil comprises a dimethylsiloxane homopolymer of the α,ω(dimethyl-vinylsiloxy)poly(dimethylsiloxyl) type.

In some example, the silicone oil comprises a co-polymer of vinylmethylsiloxane and dimethylsiloxane, and in some examples, a vinyl group is covalently bonded to each of the end siloxyl units of the co-polymer. In some examples the co-polymer of vinylmethylsiloxane and dimethylsiloxane is of the poly(dimethylsiloxyl)((methylvinylsiloxy)α,ω(dimethyl-vinylsiloxy) type.

In some examples, the silicone oil comprises a dimethylsiloxane homopolymer, in which the alkene groups are vinyl, and are each covalently bonded to end siloxyl units, which may be as described above and a co-polymer of vinylmethylsiloxane and dimethylsiloxane, and, in some examples a vinyl group is covalently bonded to each of the end siloxane units of the co-polymer.

The silicon hydride component may comprise a polysiloxane having a silicon hydride (Si—H) moiety. The silicon hydride moiety may be at an end siloxyl unit or an intermediate siloxyl unit in the polysiloxane of the silicon hydride component. In some examples, the silicon hydride component is selected from a polysiloxane of the poly (dimethylsiloxy)-(siloxymethy)-α,ω-(dimethylhydrosiloxy) type and α,ω-(dimethylhydrosiloxy) poly-dimethylsiloxane.

The monoalkenylsiloxane may be as described herein.

Once cured, the ITM comprises an outer release layer 30 disposed on a substrate layer 23, or, if present, disposed on a primer layer 28.

The silicone polymer matrix of the outer release layer 30 comprises the cross-linked product of the at least one silicone oil and the silicon hydride cross-linking component.

EXAMPLES

The following Examples illustrate a number of variations of intermediate transfer members and related aspects that are presently known to the inventors. However, it is to be understood that the following are only examples or illustrative of the application of the principles of the present printing apparatus, intermediate transfer member and related aspects. Numerous modifications and alternative intermediate transfer members may be devised by those skilled in the art without departing from the spirit and scope of the printing apparatus, intermediate transfer member and related aspects. The appended claims are intended to cover such modifications and arrangements. Thus, while the present methods and related aspects have been described above with particularity, the following examples provide further detail in connection with what are presently deemed to be acceptable.

ITM (Blanket) Structure and Release Application

The blanket structure from bottom to top (top is a release layer; bottom is a layer which is in contact with metal ITM drum):

1. Fabric based (woven or non-woven cotton, synthetic, combined, treated (according to heat resistance needed in some case) support layer.
2. Rubber based (NBR, HNBR, ACM, EPDM, PU,FLS or other) compressible layer with large range of compressibility (in this example NBR from ContiTech AG Vahrenwalder Str. 9 30165 Hannover Germany)
3. Rubber based (NBR, HNBR, ACM, EPDM other mentioned in all blanket related ip) conductive layer (in this example NBR from ContiTech)
4. Rubber based (NBR, HNBR, ACM, EPDM, PU, FMQ, FPM, FKM, FFKM) soft compliant layer (in this example ACM from ContiTech)
5. Primer layer may comprise a one or more portion (coated on substrate (rubber layer no 4) as a layer by layer. Primer formulation is described in table 1.
6. Release layer described in table 2

TABLE 1

| Materials of primer | % in formulation | Supplier |
|---|---|---|
| 3Glycidoxypropyl) trimethoxysilane | 54 | ABCR |
| Vinyltrimethoxysilane | 35 | ABCR |
| Tyzor AA75 | 10 | Dorf Ketal |
| Karstedt solution 9% Pt | 1 | Johnson Matthey |

TABLE 2

| Materials | Parts by weight in formulation ok | Dynamic Viscosity (mPa · s) | Functional group content | Supplier |
|---|---|---|---|---|
| Dimethylsiloxane vinyl terminated (vs500) | 41 | 500 | 0.14 Vinyl (mmole/g) | ABCR |
| Vinylmethylsiloxane - Dimethylsiloxane Copolymer vinyl terminated (xprv5000) | 51 | 3000 | 0.4 Vinyl (mmole/g) | |

TABLE 2-continued

| Materials | Parts by weight in formulation ok | Dynamic Viscosity (mPa · s) | Functional group content | Supplier |
|---|---|---|---|---|
| Monofunctional vinyl silicone (Silopren TP AC 3354) | 8 | 35000 | 0.02 Vinyl (mmole/g) | Momentive |
| Hydride siloxane Crosslinker210 | 14 | 900 | 4.2 SiH (mmole/g) | ABCR |
| Inhibitor 600 | 5 | 900 | 0.11 Vinyl (mmole/g) | |
| Karstedt solution 0.5% Pt | 0.5 | 500 | 0.14 Vinyl (mmole/g) | ABCR |

*Viscosities given in table above were measured using a Brookfield DV-II+ Programmable Viscometer, spindle LV-4 (SP 64) 200-1,000 [mPa · s] for Newtonian fluids (pure silicones) and spindle LV-3 (SP 63).

An ITM comprising a metal drum and layers 1 to 4 mentioned above was coated with a primer layer (no. 5) above and then the release layer (no. 6 above). The primer was applied using a rod coating process. The first primer comprised an organosilane and a first catalyst comprised titanium, for example an organic titanate or a titanium chelate.

In this example the organosilane is an epoxysilane, for example 3-glycidoxypropyl trimethoxysilane (available from ABCR GmbH & Co. KG, Im Schlehert 10 D-76187, Karlsruhe, Germany, product code SIG5840) and vinyltriethoxysilane (VTEO, available from Evonik, Kirschenallee, Darmstadt, 64293, Germany), vinyltriethoxysilane, an allyl silane or an unsaturated silane. The first catalyst for silane condensation reaction was for example Tyzor® AA75 (available from Dorf-Ketal Chemicals India Private Limited Dorf Ketal Tower, D'Monte Street, Orlem, Malad (W), Mumbai-400064, Maharashtra INDIA.). The primer was curable by for example a condensation reaction. The second catalyst was different from the first catalyst and for example comprises platinum. Karstedt catalyst with for example 9% platinum in solution (available from Johnson Matthey, 5th Floor, 25 Farringdon Street, London EC4A 4AB, United Kingdom) or SIP6831.2 catalyst (available from Gelest, 11 East Steel Road, Morrisville, Pa. 19067, USA). This second catalyst was carried out by primer solution to be in contact with release layer and catalyze the addition cure reaction of release layer.

A silicone release formulation was provided on the primer layer. A rod coating process was used. The substrate (ACM) was uncured at this time. In this example the silicone release formulation comprised a vinyl silicone mixture (bi functional vs500, multifunctional xprv 5000), a silicon hydride crosslinker, and a monofunctional vinyl silicone, as detailed in Table 2 above. The silicone release layer also comprised a catalyst comprising platinum, namely a Karstedt type catalyst or a Pt(O) complex with vinylsiloxane ligands; an inhibitor, for example an acetylenic alcohol, tetramethyltetravinylcyclotetrasiloxane or tetramethyldivinyldisiloxane. After coating process is complete, the whole blanket is placed in oven at 120 C for 1.5 h (for ACM uncured substrate).

Various properties of the blanket were tested. The tests were carried out as follows. The results are shown in Table 3 below.

Bulk Swelling

Release bulk was prepared in specific form (size 3×3 cm, 2 mm thick). Sample was cured at 120 C for 1.5 h in oven, as detailed above, prior to the swelling test. Then initial sample weight was monitored (dry) and the sample immersed into isopar oil for 12 h at 100 C. Them weight after swelling was recorded and swelling capacity of sample was calculated according following equation: ((wet wt-dry wt)/dry wt)*100.

Tack(Force)

Surface Tackiness Test (ASTM D3121-06)

Standard Test Method for Tack of Pressure-Sensitive Adhesives by Rolling Ball was adjusted for blanket layers tackiness. This can indicate softness, curing level and stickiness of blanket surface. The results can be comparable using the same blanket body for two or more tested surfaces. The test should be performed in specific conditions: T=22C; RH=55

Metal ball (Ø=5 mm) was rolled on blanket surface using inclined path. The distance the ball runs was converted to tack force by: Tack force (100/D,D(cm).

Delta Gloss

Delta gloss is a difference of the gloss on dry release surface and surface swollen in isopar. The larger delta indicated high swelling capability. This method is used to monitor curing level (if delta is high for specific formulation, that means the curing of release was not done properly; releases with different swelling will result in different delta gloss)

Bulk Hardness

This was tested according to the ASTM D2240-00-rubber durometer hardness. Shore A hardness was tested.

A reference blanket was also tested that was produced in the same method as detailed above, using the ITM having layers 1 to 4, the primer layer (from the formulation in Table 1) and the release layer (from the formulation in Table 2), except that in the release layer, no Silopren TP AC 3354 was included (although the other components of the release layer were approximately the same, and so were their parts by weight-in the formulation, except that the reference sample comprised 50/50 vs500/xprv5000 (total 100% vinyl polymers).

Table 3 below shows the results for the reference blanket (denoted 'Ref') and the blanket having the monofunctional-siloxane incorporated into the release layer (denoted 'MF').

TABLE 3

| | Ref | MF |
|---|---|---|
| % MF | 0 | 8 |
| Bulk swelling [% w/w] | 77 ± 2 | 80 ± 3 |
| Tack (Force) [$cm^{-1}$] | 3 | 6 |
| Delta gloss (0-10) [gloss units] | 4 | 1.2 |
| Bulk hardness (ShA) | 45 | 45 |

It was found that the tack force was increased, but the other properties tested were not altered to any significant degree, particularly the bulk swelling and the bulk hardness.

While the electrostatic printing apparatus, intermediate transfer members and related aspects have been described with reference to certain examples, those skilled in the art will appreciate that various modifications, changes, omissions, and substitutions can be made without departing from the spirit of the disclosure. It is intended, therefore, that the present method and related aspects be limited only by the scope of the following claims. Unless otherwise stated, the features of any dependent claim can be combined with the features of any of the other dependent claims or independent claims.

The invention claimed is:

1. An electrostatic printing apparatus, comprising:

a photoconductive member having a surface on which can be created a latent electrostatic image; and an intermediate transfer member having an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane;

wherein the electrostatic printing apparatus is adapted, in use, on contacting the surface of the photoconductive member with an electrostatic ink composition to form a developed toner image on the surface of the latent electrostatic image, then transfer the developed toner image to the outer release layer of intermediate transfer member, and then transfer the developed toner image from the outer release layer of the intermediate transfer member to a print substrate;

wherein the polysiloxane has been cross-linked using an addition cure process involving the addition cure of:

a first component comprising a polysiloxane having at least two alkene groups per molecule;

a second component comprising a polysiloxane having a silicon hydride moiety; and a third component comprising a monovinyl siloxane;

and wherein the vinyl group of the monovinyl siloxane is covalently bonded to an end siloxyl unit of the siloxane chain or an intermediate siloxyl unit of the siloxane chain, and the rest of the siloxyl units of the siloxane chain have unsubstituted alkyl or aryl groups attached.

2. An electrostatic printing apparatus, comprising:

a photoconductive member having a surface on which can be created a latent electrostatic image; and an intermediate transfer member having an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane;

wherein the electrostatic printing apparatus is adapted, in use, on contacting the surface of the photoconductive member with an electrostatic ink composition to form a developed toner image on the surface of the latent electrostatic image, then transfer the developed toner image to the outer release layer of intermediate transfer member, and then transfer the developed toner image from the outer release layer of the intermediate transfer member to a print substrate;

wherein the polysiloxane has been cross-linked using an addition cure process involving the addition cure of:

a first component comprising a polysiloxane having at least two alkene groups per molecule;

a second component comprising a polysiloxane having a silicon hydride moiety; and a third component comprising a monovinyl siloxane;

and wherein the siloxane chain of the monovinyl siloxane is a straight chain, the vinyl group of the monovinyl siloxane is covalently bonded to an end siloxyl unit of the siloxane chain, and the rest of the siloxyl units of the siloxane chain have unsubstituted alkyl or aryl groups attached.

3. The electrostatic printing apparatus according to claim 1, wherein the monovinyl siloxane has a dynamic viscosity of at least 20,000 mPa·s.

4. The electrostatic printing apparatus according to claim 1, wherein the monovinyl siloxane has a dynamic viscosity of at least 30,000 mPa·s.

5. The electrostatic printing apparatus according to claim 1, wherein the third component is present in an amount of from 1 wt % to 20 wt % of the combined weight of the first, second and third components.

6. The electrostatic printing apparatus according to claim 1, wherein the third component is present in an amount of from 5 wt % to 12 wt % of the combined weight of the first, second and third components.

7. The electrostatic printing apparatus according to claim 1, wherein the first component comprises a dimethylsiloxane homopolymer, in which the alkene groups are vinyl, and are each covalently bonded to end siloxyl units.

8. The electrostatic printing apparatus according to claim 7, wherein the dimethylsiloxane homopolymer has a dynamic viscosity of from 100 to 1000 mPa·s.

9. The electrostatic printing apparatus according to claim 7, wherein the first component further comprises a co-polymer of vinylmethylsiloxane and dimethylsiloxane, and a vinyl group is covalently bonded to each of the end siloxyl units of the co-polymer.

10. The electrostatic printing apparatus according to claim 7, wherein the co-polymer of vinylmethylsiloxane and dimethylsiloxane has a dynamic viscosity of from 1000 to 5000 mPa·s.

11. An intermediate transfer member for use in an electrostatic printing process, the intermediate transfer member having an outer release layer comprising a polysiloxane that has been cross-linked using an addition cure process such that it contains Si—R—Si bonds, wherein R is an alkylene moiety, and a monoalkenylsiloxane has been reacted with and incorporated into the polysiloxane;

wherein the polysiloxane has been cross-linked using an addition cure process involving the addition cure of:

a first component comprising a polysiloxane having at least two alkene groups per molecule;

a second component comprising a polysiloxane having a silicon hydride moiety; and a third component comprising a monovinyl siloxane;

wherein:

the siloxane chain of the monovinyl siloxane is a straight chain, the vinyl group of the monovinyl siloxane is covalently bonded to an end siloxyl unit of the siloxane chain, and the rest of the siloxyl units of the siloxane chain have unsubstituted alkyl or aryl groups attached; or the vinyl group of the monovinyl siloxane is covalently bonded to an end siloxyl unit of the siloxane chain or an intermediate siloxyl unit of the siloxane chain, and the rest of the siloxyl units of the siloxane chain have unsubstituted alkyl or aryl groups attached.

12. The intermediate transfer member according to claim 11, wherein the monovinyl siloxane has a dynamic viscosity of at least 20,000 mPa·s.

13. The electrostatic printing apparatus according to claim 2, wherein the monovinyl siloxane has a dynamic viscosity of at least 20,000 mPa·s.

14. The electrostatic printing apparatus according to claim 2, wherein the monovinyl siloxane has a dynamic viscosity of at least 30,000 mPa·s.

15. The electrostatic printing apparatus according to claim 2, wherein the third component is present in an amount of from 1 wt % to 20 wt % of the combined weight of the first, second and third components.

16. The electrostatic printing apparatus according to claim 2, wherein the third component is present in an amount of from 5 wt % to 12 wt % of the combined weight of the first, second and third components.

17. The electrostatic printing apparatus according to claim 2, wherein the first component comprises a dimethylsiloxane homopolymer, in which the alkene groups are vinyl, and are each covalently bonded to end siloxyl units.

18. The electrostatic printing apparatus according to claim 17, wherein the dimethylsiloxane homopolymer has a dynamic viscosity of from 100 to 1000 mPa·s.

19. The electrostatic printing apparatus according to claim 17, wherein the first component further comprises a co-polymer of vinylmethylsiloxane and dimethylsiloxane, and a vinyl group is covalently bonded to each of the end siloxyl units of the co-polymer.

20. The electrostatic printing apparatus according to claim 17, wherein the co-polymer of vinylmethylsiloxane and dimethylsiloxane has a dynamic viscosity of from 1000 to 5000 mPa·s.

* * * * *